US005281001A

United States Patent [19]

Bergsten et al.

[11] Patent Number: 5,281,001

[45] Date of Patent: Jan. 25, 1994

[54] ERGONOMIC ARM SUPPORT

[76] Inventors: Jeffrey D. Bergsten, 6870 Meadowbrook Blvd. #435, St. Louis Park, Minn. 55426; Donald A. Bergsten, 8489 Hiawatha Ave., Eden Prairie, Minn. 55437

[21] Appl. No.: 755,432

[22] Filed: Sep. 5, 1991

[51] Int. Cl.[5] ..... A47C 7/54

[52] U.S. Cl. ..... 297/411.24; 297/411.35

[58] Field of Search ..... 297/411, 412, 415, 414, 297/416; 384/43; 248/118

[56] References Cited

U.S. PATENT DOCUMENTS

| | | | |
|---|---|---|---|
| 1,721,221 | 7/1929 | Jáuregui | 297/411 X |
| 4,332,263 | 6/1982 | Kitrell | 132/73 |
| 4,481,556 | 11/1984 | Berke et al. | 361/222 |
| 4,621,781 | 11/1986 | Springer | 248/118 |
| 4,688,862 | 8/1987 | Fowler et al. | 312/325 |
| 4,789,249 | 12/1988 | Mutolo | 384/43 |
| 4,815,862 | 3/1989 | Mugglestone et al. | 384/43 |
| 4,822,103 | 4/1989 | Stenvall | 297/411 |
| 4,997,054 | 3/1991 | Denny et al. | 297/412 X |
| 5,108,057 | 4/1992 | Dandy, III et al. | 248/118 |
| 5,143,422 | 9/1992 | Althofer et al. | 297/411 |

OTHER PUBLICATIONS

"Moving Armrest" and Ergo Chair product information Occupational Health & Safety, Sep. 1991, p. 56.

Power Trax literature, two pages (pp. 4,5) entitled Power-Trax ball splines, undated.

Unidentified literature, one page (p. 100) on spline shafts undated.

Thomson Systems literature, one page (p. 31) entitled Double Shaft Unsupported system, undated.

LM76 inc. literature, one page, (unpaginated), entitled Ceramic Linear Motion Bearings, undated.

Pacific Bearing Co. Literature, one page (unpaginated), entitled Linear Bearing Selection Guide, undated.

Mabs arm brochure, three pages (unpaginated) undated.

THK literature, one page (page 7) entitled guide Type SR . . . T/S undated.

THK literature, one page, (page 48) entitled THK type DP, undated.

THK literature, one page, (page 122) entitled THK Ball Spline Type LMT, undated.

THK literature, one page, (unpaginated) on epochal linear motion systems, undated.

Linear Industries Ltd. catalog, pp. 1-72 section A, pp. 1-5, 32-37 of Section C, pp. 1-8 of section D, copyright date of 1975, 1979.

Ergo Arm sit-rite brochure, four pages, (unpaginated) undated.

Rini ergoteknik ab brochure, two pages, (unpaginated) 85-12-15.

Rini ergoteknik ab brochure, two pages, (unpaginated) dated 1990.

*Primary Examiner*—Kenneth J. Dorner

*Assistant Examiner*—Milton Nelson, Jr.

*Attorney, Agent, or Firm*—Palmatier, Sjoquist & Helget

[57] ABSTRACT

An ergonomic arm support for supporting the forearm during typing, keying, or assembly operations. The arm support includes an armrest pivotally mounted on a slide for sliding the armrest to and away from a base which is secured to a table or chair. The slide is pivotally mounted in the base such that the armrest, which is pivotal relative to the slide and slidable to and away from the base, is also rotatable about the base to provide for a wide range of motion for the forearm. The armrest further includes a linear ball slide arrangement with ball bearings disposed in a recirculating fashion. The ball slide arrangement engages the slide relative to the housing to provide for a fluid sliding of the slide.

14 Claims, 5 Drawing Sheets

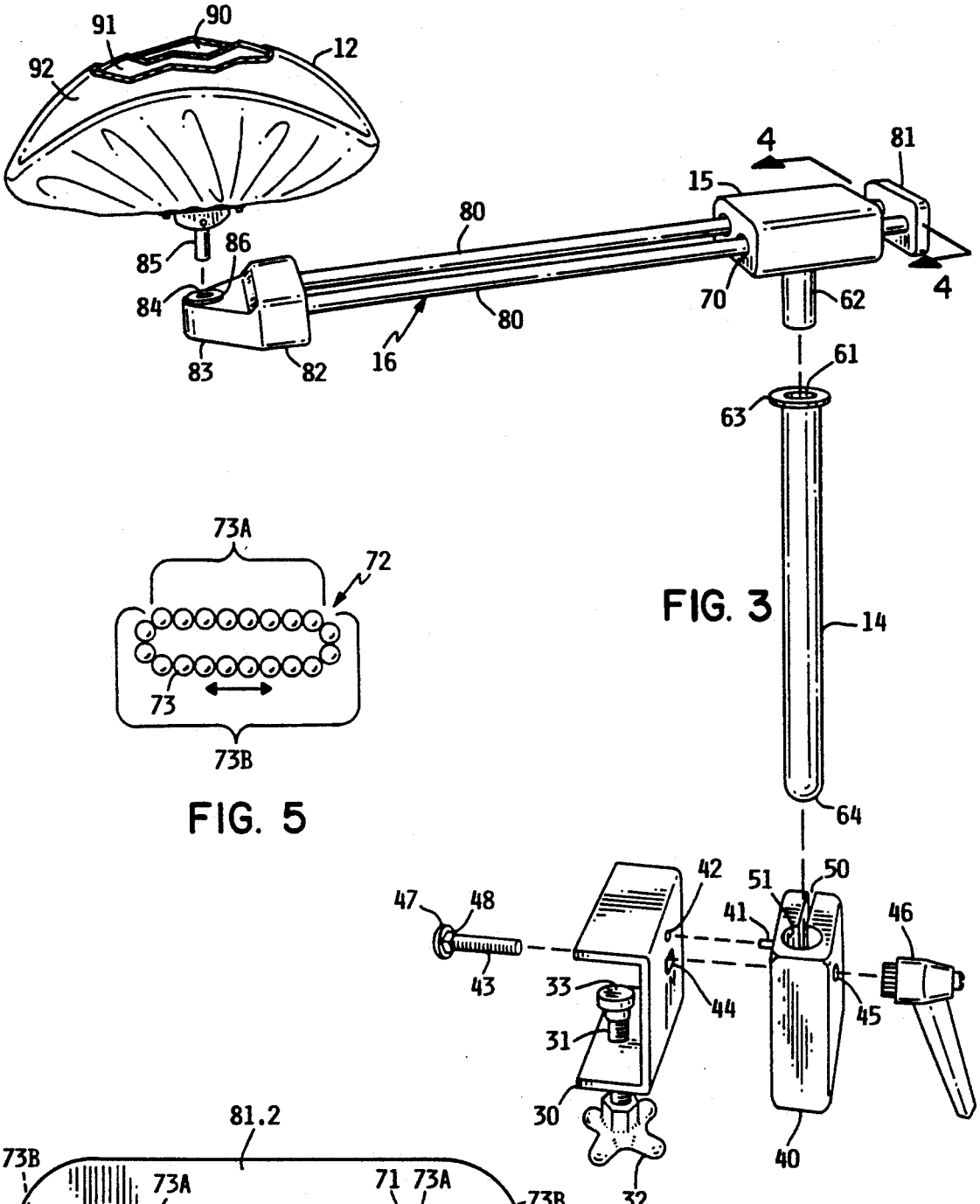
FIG. 3
FIG. 5
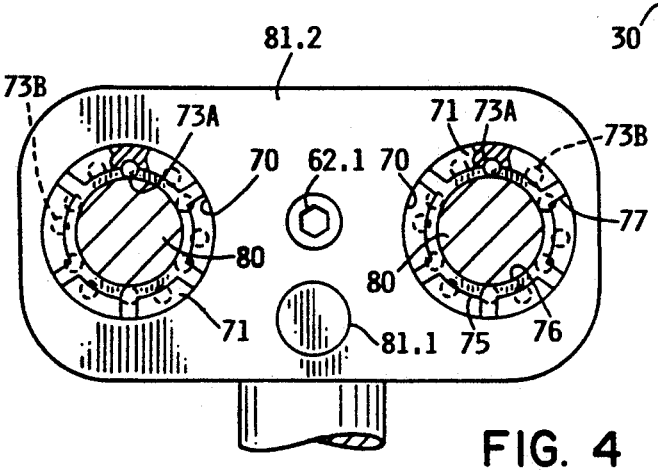
FIG. 4

ERGONOMIC ARM SUPPORT

The present invention relates to an arm support and, more particularly, to an arm support with a sliding armrest.

BACKGROUND OF THE INVENTION

Ergonomics may be defined as an engineering and physiological study of relationships between man and machines. An ergonomic device may be a device that is tailored to reflect human structure and function to, for example, enhance a person'ability to operate the device or an adjacent apparatus.

An ergonomic device may enhance a worker's performance or ability to operate a machine by relieving fatigue. For example, fatigue or repetitive motion disorders of the hand, wrist, and arm may be caused by repetitive or tedious hand, wrist, and arm functions. In the computerized white collar environment, keyboard operators may spend their entire workdays at their terminals with their forearms extended to their keyboards. Postal workers may spend long periods of time with their forearms extended to operate coding machines for coding and sorting mail. Assembly-line personnel may also work with their forearms extended over articles of manufacture to manipulate tiny parts with their fingers.

Allegedly ergonomic arm support devices have been designed for supporting the forearm of, for example, keyboard operators. These devices typically consist of two arms with one arm secured to a desk and the second arm having a cushion at its distal end for supporting the forearm. The arms are jointed at their connection, and also may be jointed at the forearm cushion and at the connection to the keyboard table for a total of three joints.

These jointed arm support devices have a number of problems. For example, the inclusion of two arms and three joints requires that the arm secured to the keyboard table be so secured at a relatively great distance from the keyboard. Accordingly, a pair of such arm support devices may require a larger desk and therefore may disadvantageously occupy a greater amount of work space. If the arm supports are in fact mounted closer to the terminal, the range of motion of each of the arm supports is limited and the arm supports may dig into a worker's torso or interfere with his or her chair.

A similar problem is that it is impractical to mount the conventional jointed arm support on a chair. If such is mounted on a chair, the long reach of its jointed two arms may interfere with access to the seat of the chair. Furthermore, the jointed arm support simply may not be reasonably operable on a chair because a chair by its very nature is drawn adjacent to the keyboard, a position in which the torso of the occupant of the chair or the keyboard may interfere with a range of motion of the second arm.

Another problem with the conventional jointed arm support is that it easily breaks when leaned upon. It is typical behavior for a worker to lean on the cushioned or distal end of the second arm of the conventional arm support which is intended for supporting only the weight of a forearm. The leverage or force exerted by the weight of such a lean or end loading is magnified by the overall length of the two arms of the jointed arm support.

Still another problem with the jointed arm support is that it is difficult to maneuver. For example, when one arm is aligned directly over the other arm and the intended direction of movement of the forearm is in line with the two arms, the arms initially resist a pivoting relative to each other until the forearm exerts a force out of alignment with the two arms. Accordingly, such a conventional jointed arm support may not meet the definition of an ergonomic device that typically tracks or follows a natural movement of the human body without resistance.

Yet another problem is that the conventional two-arm jointed arm support may not decrease substantially the risk of carpal syndrome. This syndrome may be caused at least in part by the tendency of a keyboard operator to rest his or her wrists on the keyboard or on a portion of the table immediately in front of the keyboard while his or her hands are elevated relative to the wrists for operation of the keyboard. With the long reach of the two-arm jointed arm support and the attendant amount of leverage, the arm cushion on the distal end of the second arm may sink to the table surface even under the relatively light weight of an arm. Even providing for height adjustment, such instability or deflection of the second arm may not provide a sufficient lift for the wrists to be held at the proper elevation relative to the hands to minimize the risk of carpal syndrome.

SUMMARY OF THE INVENTION

An object of the present invention is to provide an arm support with fluid motion.

Another object of the present invention is to provide a strong and durable arm support.

A feature of the present invention is the provision in an arm support with an armrest for engaging a forearm and a base for being secured to an object such as a table or chair, of connection means between the armrest and the base that includes a slide for drawing the armrest to and away from the base in a sliding fashion.

Another feature is the provision in such an arm support, of the slide engaging recirculating ball bearings to provide for a fluid motion of the armrest.

Another feature is the provision in such an arm support, of the arm support comprising one arm to minimize any leverage exerted upon the armrest.

Another feature is the provision in such an arm support, of means for preventing rotation of the slide.

Another feature is the provision in such an arm support, of an elongate support fixed to and extending from the spindle of a chair for serving as a base for the arm support.

An advantage of the present invention is that fatigue may be reduced for workers such as keyboard operators or assembly line personnel. One of the features contributing to this advantage is the recirculating ball bearings supplying a fluid motion to the armrest. Another feature contributing to this advantage is the lack of deflection or tilt of the slide or armrest even when leaned upon.

Another advantage is that the present invention may be mounted closer to the apparatus to be operated. The arm support may therefore occupy a minimal amount of space. One of the features contributing to this advantage is the provision of a slide between the armrest and the base. Another contributing feature is the provision of only one arm between the armrest and the base.

Another advantage is that the present invention has a high load capacity. It easily supports a great amount of weight on the armrest such as the weight of a worker leaning on the armrest or pushing herself or himself up and out of a chair via the arm supports. One of the features contributing to this advantage is the provision of only one arm between the armrest and the base. Another feature contributing to this advantage is the recirculating ball bearing sleeve which may handle heavy end loading while providing for fluid motion.

Another advantage is that the present invention is ergonomic. The present arm support tracks or follows natural motion with minimal resistance.

Another advantage is that the present invention is connectable to objects such as chairs, tables, table tops, wheelchairs, or machines.

Another advantage is that the present invention may be mounted close to the surface of a table top without engaging or abrading the table top even when a great amount of leverage is exerted on the armrest.

Another advantage is that the present invention aids in relieving back, neck, and muscle fatigue associated with holding an arm in an extended position.

Another advantage is that the risk of carpal tunnel syndrome may be minimized. One feature contributing to this advantage is the relative stability provided by the armrest mounted on the slide of the arm support such that the forearm and wrist are maintained at the proper elevation relative to the hand.

Another advantage is that the slide arm may be easily shortened or lengthened to accommodate varying work areas.

BRIEF DESCRIPTION OF THE DRAWINGS

FIG. 3 is an exploded perspective view of the arm support of FIG. 2.

FIG. 4 is a section view at lines 4—4 of FIG. 3.

FIG. 5 is a diagrammatic view of a recirculating ball bearing circuit utilized in the arm support of FIGS. 1 and 2.

DETAILED DESCRIPTION OF THE PREFERRED EMBODIMENTS

Figure 1:
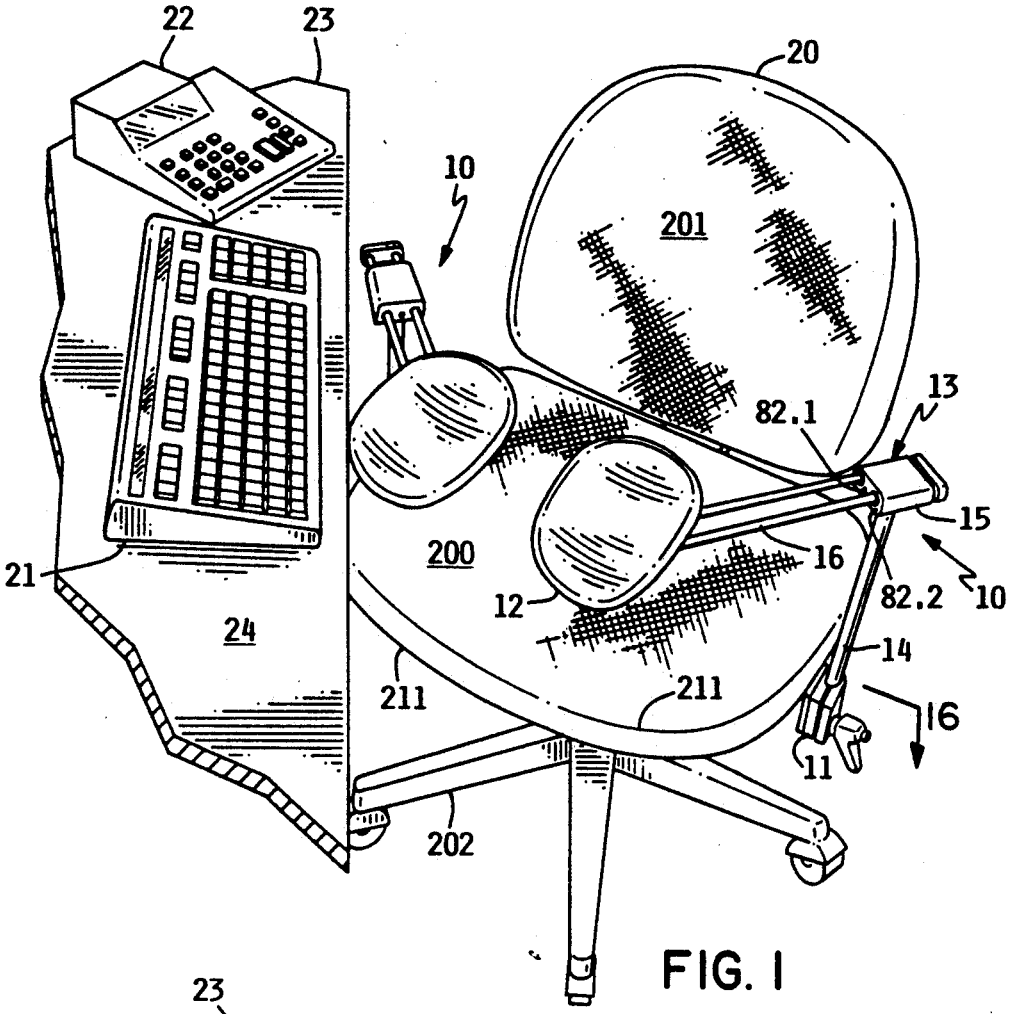
FIG. 1 is a perspective view of the present arm support mounted on a chair adjacent to a table with a keyboard and calculator.

As shown in FIG. 1, the present arm support is designated in general by the reference numeral 10 and includes as its principal components a base 11, an armrest 12, and a connection means 13 between the base 11 and the armrest 12. The connection means 13 includes a standard 14, a housing 15 with recirculating ball bearings, and a slide 16 slidable in the housing 15. The base 11 is connectable to a chair 20 via an elongate support affixed to the spindle of the chair 20. The armrests 12 engage and support the forearm and/or wrist for the operation of a keyboard 21 or calculator 22 which rest on a desk or table top 23 having a top surface 24.

Figure 2:
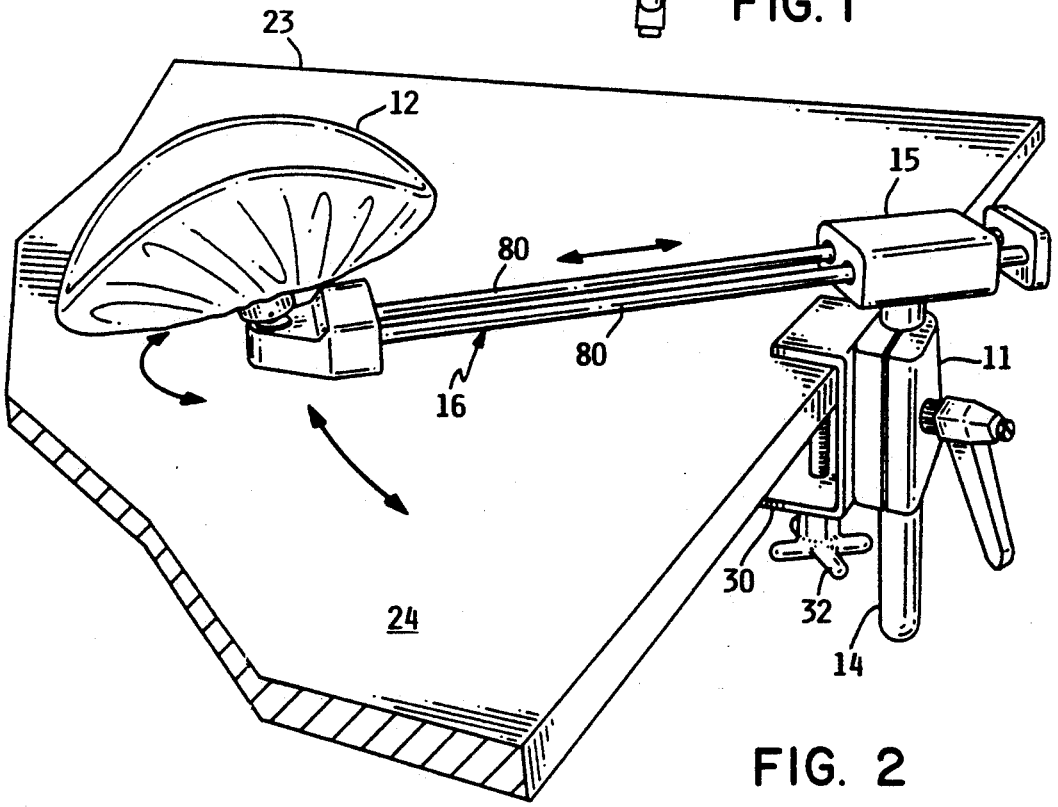
FIG. 2 is a perspective view of the arm support of FIG. 1 mounted on a table.

With more specificity, as shown in FIGS. 1, 2 and 3, the base 11 includes, if connectable to the desk 23, a generally U-shaped steel or aluminum clamp 30. The clamp 30 includes a threaded bolt 31 with a knob 32 fixed on one end and a pivotal and tiltable end piece 33 for engaging the underside of the desk top 23.

The base 11 further includes a slotted and apertured aluminum block 40 which is securable to the U-clamp 30. The block 40 includes a steel dowel pin or nub 41 for engaging an aperture 42 for alignment of block 40 relative to the U-clamp 30 and a threaded pin connector or carriage bolt 43 for being passed through respective apertures 44, 45 of the U-clamp and block 40, respectively, and engaging a threaded handle 46. The carriage bolt 43 includes a head 47 with a square portion 48 which locks into the inner portion of aperture 44 to prevent rotation of the pin connector 43 when tightened by the handle 46.

The block 40 further includes a vertical slot 50 communicating with a generally vertical standard-receiving hole 51. The aperture 45 and its respective pin connector 43 intersects the slot 50 such that the slot 50 is narrowed and the diameter of the apertures 51 is decreased when the handle 46 is tightened to squeeze the half portions of the block 40 together.

The connection means 13 includes the standard or post 14, which includes an axial seat 61 for seating a stem 62 depending from the housing 15. Seat 61 and stem 62 may be referred to as a joint. The seat 62 is fixed in a hole formed in the bottom of the housing 15 and is secured therein via a pin connector 62.1 as shown in FIG. 4. A flanged bushing 63 formed of a plastic with a low coefficient of friction such as Teflon ® is disposed in the seat 61 for engaging the stem 62 for a fluid-like swinging or pivoting of the housing 15 relative to the standard. The flanged portion of the bushing 63 typically fluidly engages the underside of the housing 15. The standard 14 is vertically adjustable in the base 11 by tightening or loosening the handle 46 to pinch or disengage the standard 14 from the aperture 61. The standard 14 further includes a rounded closed bottom end 64. The stem 62 and standard 14 are typically formed of a cold rolled steel.

As shown in FIGS. 4 and 5, the housing 15, typically formed of aluminum, includes a pair of cylindrical parallel holes 70. Two or more cylindrical recirculating ball bearing steel sleeves 71 are fixed in each of the holes 70. Each of the sleeves 71 includes six oblong circuits 72 of recirculating balls 73. Balls 73A are load carrying balls in bearing contact between the sleeve 71 and the slide 16. Balls 73B are recirculating balls free to roll in clearance provided in the sleeves 71. The slide 16 which is carrying the load on the armrest 12 is rolled freely or fluidly along the load carrying balls 73A. The sleeves 71 include retainers which guide the balls 73 in the paths of the oblong circuits 72 to prevent the balls 73 from falling out such as when the slides 16 are removed from the sleeves 71 or such as when the sleeves 71 are removed from the housing 15.

As shown in FIG. 4, each of the sleeves 71 is fixed in its respective hole 70 via a locking washer 75 with an inner diameter 75 greater than the diameter of the rods 80 for avoiding friction between the rods 80 and washers 75. Each of the washers 76 includes a set of radial legs 77 for engaging the walls of the housing 15 which form the holes 70.

Figure 14:
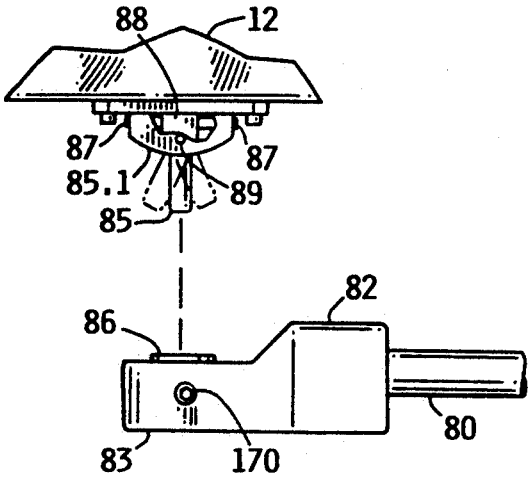
FIG. 14 shows means for tilting and locking the stem of the armrest of the arm support of FIGS. 1 and 2.

The slide 16 includes two steel linear rods 80 which actually engage the load-carrying balls 73A. The rods 80 may be stainless steel rods or be chrome-plated to prevent rust. The rods 80 are parallel to each other and spaced in such relation by a rear stop 81 and a front stop 82. The rear stop 81 is an aluminum plate fixed to and between the rear ends of the rods 80 and engages a resilient bumper 81.1 on the rear end 81.2 of the housing 15 to prevent a further sliding of the slide 16 in a forward direction. The front aluminum stop 82 is fixed to and between the front ends of the rods 80 and engages a resilient bumper 82.1 on the front end 82.2 of the housing 15 to prevent a further sliding of the slide 16 in a rearward direction. The front stop 82 includes an integral triangular platform 83 with a seat or aperture 84 for a stem 85 depending from a foundation 85.1 for the armrest 12. Seat 84 and stem 85 may be referred to as a joint. A flanged bushing 86 is disposed in the seat 84 to provide for a fluid pivoting of the stem 85 and armrest 12 relative to the seat 84 and slide 16. The bushing 86 is formed of a plastic with a low coefficient of friction such as Teflon®. A tilt to the arm rest 12 may be provided by adjusting the angle of the stem 85 relative to the armrest 12. Such a tilt is effectuated by loosening and tightening a pair of opposing pin connectors 87, as shown in FIG. 14, against an inner end 88 of the stem 85. Stem 85 includes a pivot 89 connected to the armrest foundation 85.1.

The armrest 12 includes a rigid aluminum curved or bowed plate 90 to which a closed cell foam padding 91 is affixed. A removable, washable fabric covering 92 overlays the cushioned plate 90 and padding 91. The plate 90 may be formed of plastic.

In operation, to install the arm support 10, the U-shaped clamp 30 is clamped to the desired position on the table top 23 by tightening the knob 32. The desired height for the armrest 12 or slide 16 relative to the table surface 24 is determined by orienting the standard 14 at the proper height by tightening the handle 46. The stem 62 of the slide 16 is then inserted in its seat 61 of the standard 14. The proper tilt of the stem 85 of the armrest 12 is set by turning the pin connectors 87. Subsequently the stem 85 of the armrest 12 is seated in its seat 84 to complete setup of the arm support 10.

For keying or other similar operations, a forearm and/or a wrist is placed on the armrest 12. While the forearm or wrist is on the armrest 12, the armrest 12 is swingable for 360° relative to the slide 16 via the stem 85 and seat 84; the armrest 12 is slidable to and away from the housing 15 via the slide 16; and the armrest 12 is swingable for 360° about the standard 14 via the stem 62 and seat 61. During such movements, the armrest 12 fluidly follows the lead of the forearm via the Teflon® bushing 86 between the stem 85 and seat 84, the recirculating balls 73 which engage the rods 80, and the Teflon® bushing 63 between the stem 62 and seat 61.

Figure 6:
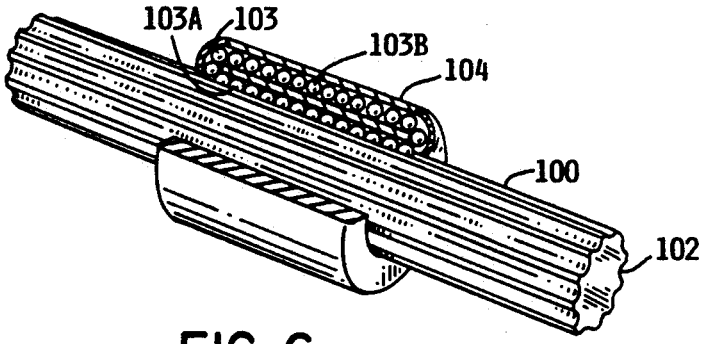
FIG. 6 is a perspective partial view of an alternate embodiment of the present arm support and shows a splined slide for engaging recirculating ball bearings to prevent rotation of the slide.
Figure 7:
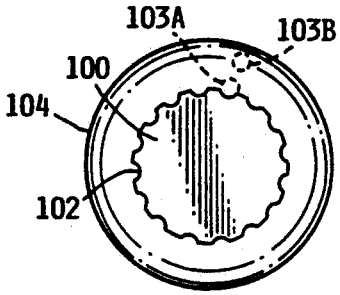
FIG. 7 is a section view of the alternate embodiment of FIG. 6.

As shown in FIGS. 6 and 7, in an alternate embodiment of the invention, an arm support may include only one rod or shaft slide 100. The rod or slide 100 includes a number of splines 102 or means for preventing rotation 102 of the slide 100. At least three of the splines 102 are engaged by recirculating balls 103 of a recirculating ball sleeve 104 to prevent rotation of the slide 100. Balls 103A are shown as engaging one of the splines 102; balls 103B are shown as recirculating in a circuit. In such an arrangement, although more than one slide 100 may be used for greater support, only one slide 100 is preferred to conserve space and weight. It should be noted that the provision of two rods 80 in the arm support 10 may also be referred to as a means for preventing rotation of the slide 16.

Figure 8:
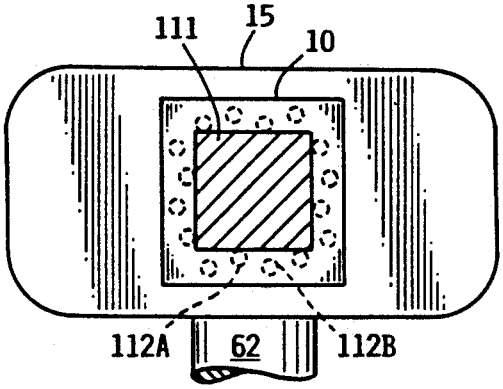
FIG. 8 is a section partial view of an alternate embodiment of the present arm support and shows a slide with a square cross section to prevent rotation of the slide.
Figure 9:
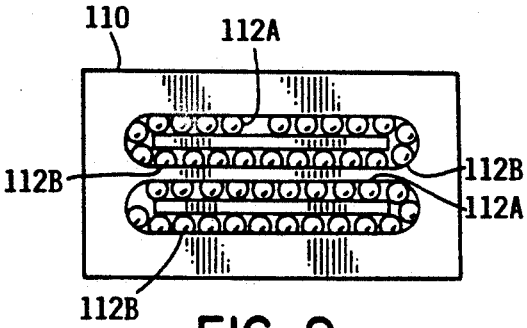
FIG. 9 is a section partial view of the alternate embodiment FIG. 8 and illustrates recirculating ball bearing circuits.

As shown in FIGS. 8 and 9, in an alternate embodiment of the invention, the housing 15 includes a recirculating ball bearing sleeve 110 with a square cross section for engaging a rod or slide 111 with a square cross section. The recirculating ball bearing sleeve 110 includes recirculating balls 112 with balls 112A engaging the slide 111 and balls 112B being recirculated from engagement. Such a noncircular, squared shape of the sleeve 110 and slide 111 prevents rotation of the slide 111 and may be referred to as a means for preventing torque or rotation of the slide 111.

Figure 10:
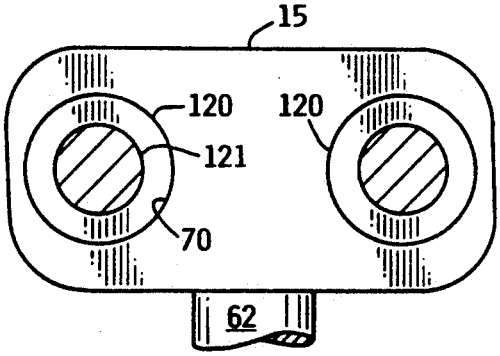
FIG. 10 is a section, partial view of an alternate embodiment of the present arm support and shows a slide engaging a ceramic pillow block or sleeve with a low coefficient of friction.

As shown in FIG. 10, in another alternate embodiment of the invention, the housing 15 includes a pair of cylindrical pillow blocks or sleeves 120 engaging the pair of rods 80 for forming a slide. The sleeves 120 are formed of a ceramic with a low coefficient of friction such as Frelon® and are fixed in the apertures 70 of the housing 15.

Figure 11:
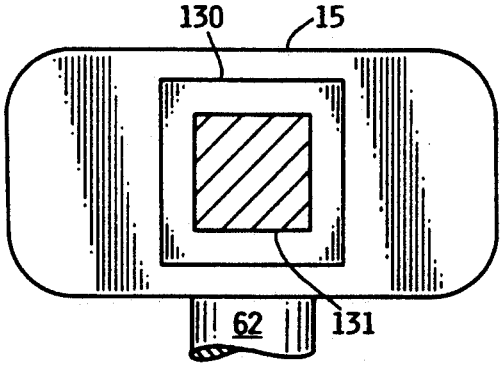
FIG. 11 is a section, partial view of an alternate embodiment of the present arm support and shows a slide with a square cross section engaging a ceramic pillow block or sleeve with a low coefficient of friction.

As shown in FIG. 11, in another alternate embodiment of the invention, the housing 15 includes a sleeve or pillow block 130 which is formed of a ceramic with a low coefficient of friction such as Frelon®. The sleeve or means for preventing rotation 130 is square in cross section for engaging a rod or slide 131 square in cross section to prevent rotation of the rod 131. As with sleeve 120, sleeve 130 is fixed in the housing 15.

Figure 12:
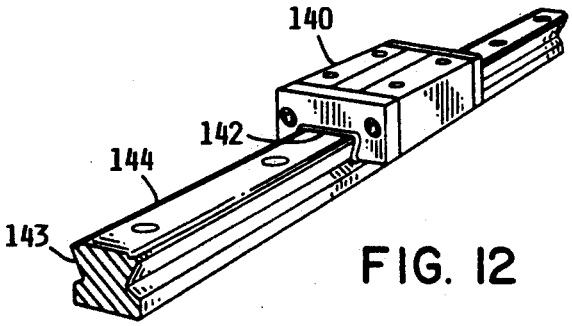
FIG. 12 is a section, partial view of an alternate embodiment of the present arm support and shows a slide engaging recirculating ball bearings in a track formed in a housing.

As shown in FIG. 12, in another alternate embodiment of the invention, a housing such as the housing 15 may include a block 140. The block 140 includes a dovetailed track 142 with recirculating ball bearings. A dovetailed portion 143 of a slide or rail 144 engages the recirculating ball bearings of the dovetailed track 142 for mounting the armrest 12.

Figure 13:
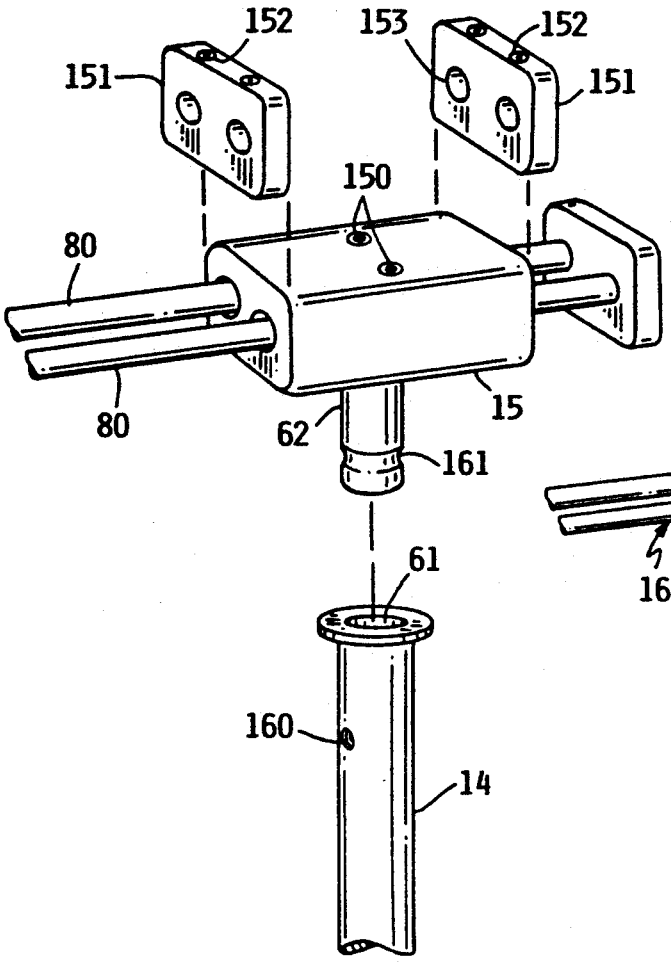
FIG. 13 is an exploded view showing slide restrictions for the arm support of FIGS. 1 and 2.

As shown in FIG. 13, in an alternate embodiment of the invention, the housing 15 may have various means for at least partially limiting or restricting or locking sliding of the slide 16. Such means includes a pair of threaded pin connectors 150 in the base 15 for being tightened against the rods 80. Such means may also include removable end stops 151 with pin connectors 152 for engaging the rods 80. For locking the slide 16 at a particular location for locating the armrest 12 at a particular location, both of the end stops 151 may be utilized. For shortening or lengthening the effective sliding of the slide 16, one of the end stops 151 is utilized. One of the end stops 151 is placed on the slide 16 by removing end stop 81 or 82 which is fixed to the slide 16 via set screws or pin connectors, and then sliding the end stop 151 on to the slide 16 via apertures 153. The end stop 151 is then fixed to the slide 16 via set screws 152. As the slide 16 is used to shorten or lengthen the stroke of the slide 16, it may be referred to as means for controlling or adjusting the length of the stroke of the slide.

Also as shown in FIG. 13, the standard 14 may include a means for limiting or restricting or locking pivoting of the stem 62 relative to the standard 14. Such means may include a pin connector 160 for engaging an annular groove 161 formed on the stem 62. Such an engagement also prevents inadvertent removal of the stem 63 from the seat 61.

As shown in FIG. 14, in an alternate embodiment of the invention, the slide 16 may include means for limiting or restricting or locking pivoting of the armrest 12 relative to the slide 16. Such means may include a pin connector 170 in the triangular piece 83 of the slide 16 for engaging the stem 85.

Figure 15:
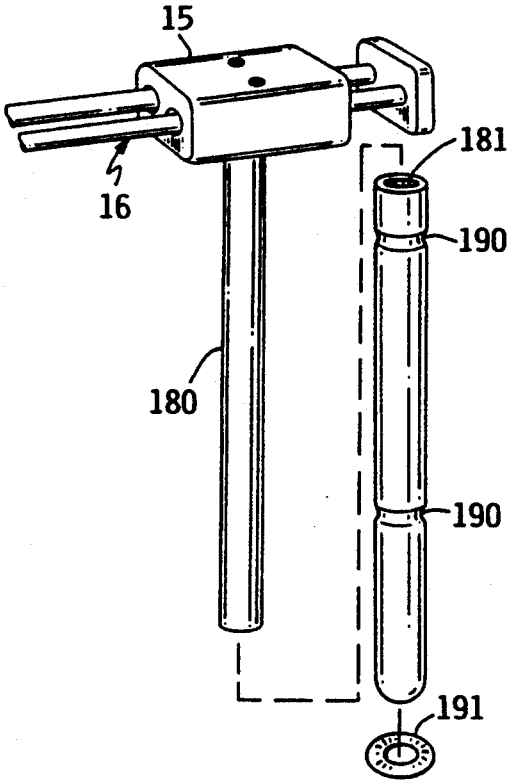
FIG. 15 shows an alternate standard for the arm support of FIGS. 1 and 2.

As shown in FIG. 15, in an alternate embodiment of the invention, an elongate stem 180 replaces the shorter stem 62. The seat 181 is formed to a greater depth in the standard 14 to accommodate the longer stem 180. The longer stem 180 and seat 101 are precision formed and may include a lubrication such as a Teflon® grease to provide for a fluid pivoting between the stem 180 and seat 181. The lubrication or grease may include molybdenum disulfide. An advantage of the longer stem 180 is that it may minimize a tilting or deflection of the housing 15 and slide 16 such that the triangular end piece 83 is less likely to scrape against the surface 24 of the table 23 when the armrest 12 is supporting a relatively great amount of weight. In other words, with a longer stem 180, the slide 16 is more likely to remain parallel to the table surface 24. Accordingly, the housing 15 and slide 16 may be mounted closer to the table surface 24. It should further be noted that the stems 62, 180 may be replaced by a needle bearing.

As also shown in FIG. 15, in alternate embodiment of the invention, the standard 14 may include annular seats 190 for seating an O-ring or safety washer or stop 191 for preventing the standard 14 from falling to the floor when the handle 46 is loosened to widen the diameter of the aperture 51 to release the standard 14. If the aperture 51 is so widened and the standard 14 slips downwardly, the safety washer 191 prevents the standard 14 from falling out of the block 40 by engaging the top of the block 40.

As shown in FIG. 1 and 16–18, the chair 20 includes a seat or seat pan 200, a back support 201, and a set of legs 202. The seat 200 is fixed to a spindle 203 which pivots in a bushing 204, which in turn is fixed to the legs 202. In an alternate embodiment of the invention, a pair of elongate supports 205 are fixed to the spindle 203 for pivoting with the seat 200 and back support 201. Each of the elongate supports 205 includes a bar formed in generally the shape of an "L" with a proximal end 206 and a bent distal end 207. Apertures 208 are formed in each of the proximal ends 206 of each of the elongate supports 205 for receiving the threaded ends of a pair of U-bolts 209 for fixing the elongate supports 205 to each other and to the spindle 203 via locking nuts 210. The effective length of each of the elongate supports 205 relative to a periphery 211 of the chair seat 200 is adjustable via the plurality of apertures 208. The block or base portion 40 is connectable to the distal end 207 which includes apertures 213, 214 identical in orientation to respective apertures 42, 44 of U-clamp 30 for engaging pins 41 and 43. As an alternative to the plurality of apertures 208, the elongate supports 205 may include slots 215 for engaging U-bolts 209. Accordingly, the arm support 10 rotates with the seat pan 200 via the elongate support 205, which is fixed to the spindle 203 with no drilling or damage thereto.

Figure 17:
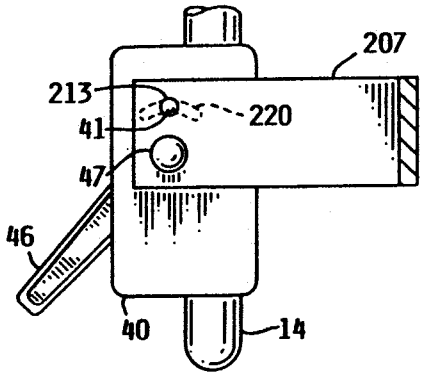
FIG. 17 is a section view at lines 17—17 of FIG. 16.

In an alternate embodiment of the invention, as shown in FIG. 17, a groove 220 may be formed in the face of distal end 207 which confronts the base portion 40. In this embodiment the dowel pin 43 is shortened to a nub and the aperture 41 is eliminated to be replaced by the groove 220. The groove 220 is curved radially about aperture 214 and includes an undulating floor to define certain seats for the nub. Accordingly, the standard 14, the slide 16 and the armrest 12 are tiltable relative to the base portion 40 by being pivotal about pin connector 43. Such a groove 220 may also be formed in the surface of the U-clamp confronting the base portion 40.

Figure 19:
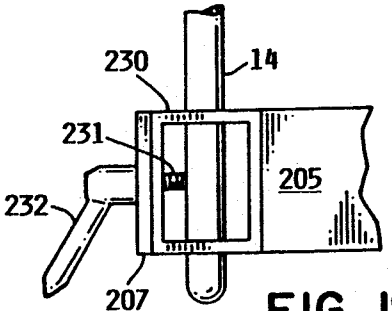
FIG. 19 is a front elevation view of an alternate embodiment of a base fixed to the elongate support of FIG. 16.

It should be further noted, as shown in FIG. 19, that instead of the base 40, the elongate support 205 may include a tubular member 230 affixed to the inner side of end 207. The tubular member 230 engages apertures formed in tubular member 230 and is engaged by a male pin connector 231 of a handle 232. The pin connector 231 is threadably engaged with the end 207 and one side of the tubular member 230. Accordingly, the standard 14 is adjustable in height in the tubular member 230.

Figure 16:
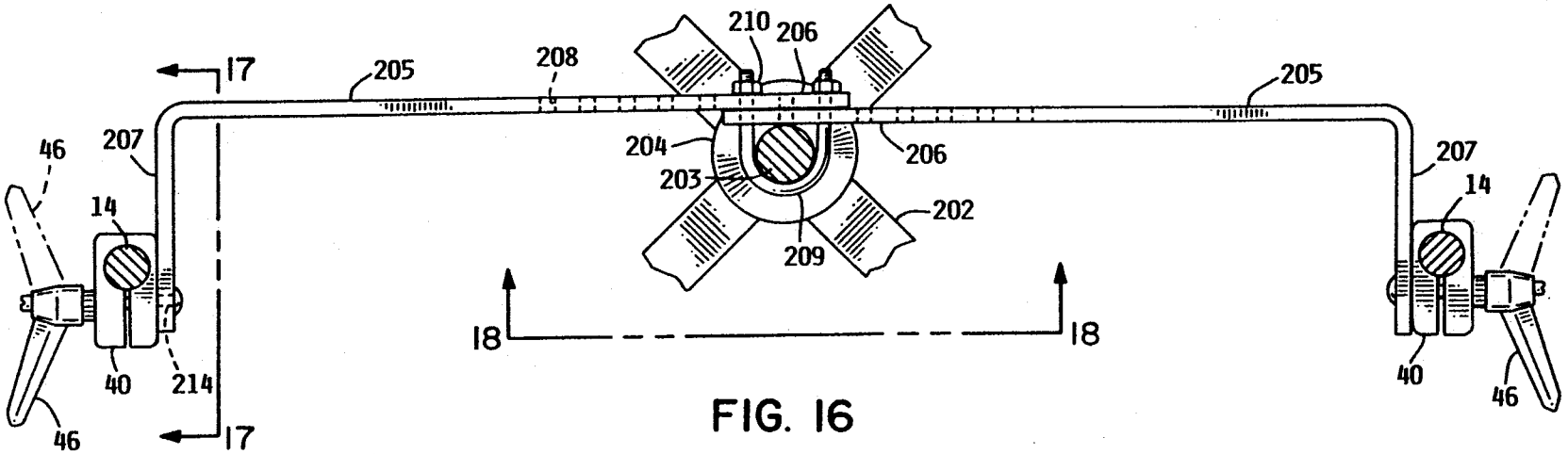
FIG. 16 shows a section view at lines 16—16 of FIG. 1 to illustrate an elongate support for fixing the present arm support to the spindle of a chair.
Figure 18:
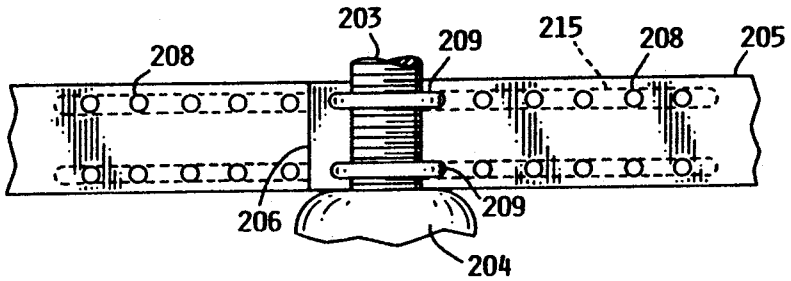
FIG. 18 is a section view at lines 18—18 of FIG. 16.

It should be noted that the handle 46 may be of a spring-loaded type such that the handle 46 may be oriented in a different position without a further tightening or disengagement of the standard 14 from the block 40. FIG. 16 shows such relative orientation of the handle 96 to, for example, move the handle 46 to an out-of-the way position to prevent inadvertent bumping of the handle 46.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An arm support connectable to an object, comprising:

(a) a base connectable to the object;

(b) an arm rest for engaging at least a portion of an arm; and (c) at least two linear slides having a housing confining a plurality of ball bearings, said ball bearings engaging a portion of said linear slides for reducing friction generated by said linear slides, said linear slides and said housing connectable between said base and said arm rest for sliding said arm rest to and away from said base, said linear slides being swingable relative to said base, said housing preventing axial rotation of said linear slides, said arm rest being swingable relative to said linear slides, said housing further having a standard connected and vertically adjustable to said base, whereby a wide range of fluid motion is provided for said arm supported by said arm rest.

2. The arm support of claim 1, wherein the ball bearings are arranged in a recirculating fashion.

3. The arm support of claim 1, wherein the armrest is tiltable relative to the base.

4. The arm support of claim 1, and the object comprising a chair, the chair including a pivotal seat having a periphery, a set of legs, and a spindle fixed to the seat for pivoting with the seat relative to the legs, the base comprising:

an elongate support fixable to the spindle and extending at least to the periphery of the seat and having a distal end which the arm support is mountable.

5. An arm support connectable to an object, comprising:

(a) a base having a vertically adjustable standard connectable to said object;

(b) an arm rest for engaging at least a portion of an arm; and (c) an extension means comprising a linear slide and a housing between said base and said arm rest for connection and extension of said arm rest relative to said base, said linear slide being slidable relative to said housing, said housing having a recirculating ball bearing arrangement for reducing friction between said linear slide whereby a wide friction between said linear slide whereby a wide range of fluid motion is provided for the arm supported by the arm support, said housing further having a stem seated in said standard providing pivotal and swingable rotation of said arm support relative to said object.

6. An arm support for supporting a portion of an arm adjacent to an object, comprising:

a) a base connectable to the object and comprising a standard vertically adjustable in the base;

b) a housing having a pair of apertures and a stem, the apertures being parallel to each other and linear, the stem extending downwardly and at a right angle to the apertures, the stem being pivotally seated in the standard such that the housing is pivotal relative to the base;

c) a pair of parallel rods slidable in the apertures, respectively, each of the rods having front and rear ends;

d) a set of recirculating ball arrangements with ball bearings disposed in a recirculating fashion between the housing and the rods, respectively, for engaging the rods to provide for a fluid sliding of the rods;

e) a rear stop fixed to and between the rear ends of the rods for fixedly spacing the rods apart in parallel fashion and for stopping sliding of the rods in a forward direction;

f) a front stop fixed to and between the front ends of the rods for fixedly spacing the rods apart in parallel fashion and for stopping sliding of the rods in a rearward direction; and an armrest pivotally seated on the front stop, the armrest also being tiltably adjustable relative to the front stop and parallel rods whereby the arm support provides a wide range of fluid motion for the portion of the arm.

7. An arm support connectable to an object, comprising:

a) a base connectable to the object said base having a vertically adjustable standard;

b) a housing having a pair of apertures and a stem, said stem seated in said standard providing pivotal and swingable rotation of said housing relative to said base;

c) a rod passing through each of said apertures slidably engaged to said housing;

d) a set of ball arrangements having ball bearings disposed in said housing between said rods providing fluid sliding of said rods; and e) an armrest pivotally affixed to said rods for engaging at least a portion of an arm whereby a wide range of fluid motion is provided for said arm supported by said arm support.

8. The arm support of according to claim 7, wherein said arm rest is tiltable relative to said rods.

9. An arm support connectable to an object for supporting a portion of an arm adjacent to said object, comprising:

a) a base connectable to said object, said base having a standard;

b) a housing having a pair of parallel and longitudinal apertures and a stem perpendicular to said apertures, said stem pivotally seated in said standard;

c) a rod slidably passing through each of said apertures;

d) a set of recirculating ball arrangements having ball bearings disposed in a recirculating fashion inside said housing engaging said rods;

e) a rear stop affixed to said rods;

f) a front stop affixed to said rods opposite said rear stop; and g) an arm rest pivotally and tiltably affixed to said rods proximal to said front stops.

10. An arm support for supporting a portion of an arm adjacent to an object, comprising:

a) a base having an adjustable standard connectable to said object, b) a housing having at least two apertures and a stem, said stem seated in said standard;

c) a rod slidably passing through each aperture;

d) a set of ball bearing arrangements having ball bearings disposed inside said housing engaged to said rods;

e) a rear stop affixed to said rods; and f) an armrest pivotally affixed to said rods opposite said rear stop.

11. The arm support according to claim 10, wherein said object comprises: a chair, the chair including a pivotal seat having a periphery, a set of lets, and a spindle fixed to the seat for pivoting of the seat relative to the legs, said base comprising:

an elongate support fixable to the spindle and extending at least to the periphery of the seat and having a distal end on which said arm support is mountable.

12. The arm support according to claim 11, wherein said armrest engages a portion of an arm and said armrest is tiltably affixed to said rods providing a wide range of fluid motion for said arm supported by said arm support.

13. The arm support according to claim 12, wherein said arm rest is slidable toward and away from said housing and said base.

14. The arm support according to claim 13, wherein said elongate support comprises means for fixably adjusting the distal end of the elongate support to and away from the periphery of the seat.

* * * * *

UNITED STATES PATENT AND TRADEMARK OFFICE

CERTIFICATE OF CORRECTION

PATENT NO. : 5,281,001

DATED : JANUARY 25, 1994

INVENTOR(S) : JEFFREY D. BERGSTEN and DONALD A. BERGSTEN

It is certified that error appears in the above-indentified patent and that said Letters Patent is hereby corrected as shown below:

In Column 1, Line 13, the word "person'" should be changed to --person's--.

At the beginning of Column 9, Line 60, --(g)-- should be placed before the word "an".

In Column 10, Line 49, the word "lets" should be changed to --legs--.

Signed and Sealed this

Twentieth Day of December, 1994

*Attest:*

Bruce Lehman

BRUCE LEHMAN

*Attesting Officer*

*Commissioner of Patents and Trademarks*